US011028669B2

(12) United States Patent
MacDonald et al.

(10) Patent No.: US 11,028,669 B2
(45) Date of Patent: Jun. 8, 2021

(54) PRESSURE ACTIVATED PROPORTIONAL FLOW BYPASS TOOL ASSEMBLY

(71) Applicant: ADVANTAGE DOWNHOLE SYSTEMS, LLC, Houston, TX (US)

(72) Inventors: Robert Paul MacDonald, Houston, TX (US); Kyle Lamar Taylor, Spring, TX (US)

(73) Assignee: ADVANTAGE DOWNHOLE SYSTEMS, LLC, Houston, TX (US)

( * ) Notice: Subject to any disclaimer, the term of this patent is extended or adjusted under 35 U.S.C. 154(b) by 0 days.

(21) Appl. No.: 16/655,101

(22) Filed: Oct. 16, 2019

(65) Prior Publication Data

US 2020/0123877 A1 Apr. 23, 2020

Related U.S. Application Data

(60) Provisional application No. 62/766,431, filed on Oct. 17, 2018.

(51) Int. Cl.

| | |
|---|---|
| ***E21B 34/14*** | (2006.01) |
| ***E21B 21/10*** | (2006.01) |
| ***E21B 37/00*** | (2006.01) |
| ***E21B 34/10*** | (2006.01) |

(52) U.S. Cl.

CPC ..... *E21B 34/14* (2013.01); *E21B 21/103* (2013.01); *E21B 34/10* (2013.01); *E21B 37/00* (2013.01)

(58) Field of Classification Search

CPC ..... E21B 34/14; E21B 21/103; E21B 34/10; E21B 37/00

See application file for complete search history.

(56) References Cited

U.S. PATENT DOCUMENTS

| | | | |
|---|---|---|---|
| 6,293,342 | B1 | 9/2001 | McGarian et al. |
| 6,675,897 | B1 | 1/2004 | McGarian et al. |
| 7,299,880 | B2 | 11/2007 | LoGuidice et al. |
| 7,334,597 | B1 | 2/2008 | Hughes et al. |
| 7,891,428 | B2 | 2/2011 | Martin et al. |
| 8,393,403 | B2 | 3/2013 | de Boer |
| 8,534,369 | B2 | 9/2013 | deBoer |
| 9,260,938 | B2 | 2/2016 | Holderman et al. |
| 9,404,326 | B2 | 8/2016 | Zhou |
| 9,494,014 | B1 | 11/2016 | Manke et al. |
| 9,708,872 | B2 | 7/2017 | O'Neal et al. |

(Continued)

*Primary Examiner* — Tara Schimpf
*Assistant Examiner* — Dany E Akakpo
(74) *Attorney, Agent, or Firm* — Craft Chu PLLC; Andrew W. Chu

(57) ABSTRACT

The tool assembly includes a main body and a bypass assembly. The main body has an off-set through bore and a cavity to fit the bypass assembly. The cavity includes a cavity surface, a first fluid bypass port, a second fluid bypass port, and a pressure inlet port. There is also a flow restrictor in fluid connection with the pressure inlet port. The bypass assembly includes a bypass housing, a pressure chamber, a piston with a first piston position and a second piston position, and a spring assembly. A pressure differential created by fluid flow through the pressure chamber and flow restrictor actuates the piston between the first piston position and the second piston position. The proportional flow through the tool assembly and through the bypass ports can now be controlled to perform the downhole work, including drilling and hole cleaning.

20 Claims, 5 Drawing Sheets

(56) References Cited

U.S. PATENT DOCUMENTS

| | | | | |
|---|---|---|---|---|
| 9,890,601 | B2 | 2/2018 | Baudoin | |
| 9,903,180 | B2 | 2/2018 | Boutin et al. | |
| 10,100,605 | B2 | 10/2018 | Gay et al. | |
| 10,107,073 | B2 | 10/2018 | Cramer et al. | |
| 2005/0269134 | A1* | 12/2005 | Strazhgorodskiy ..... | E21B 21/16<br>175/57 |
| 2015/0159466 | A1* | 6/2015 | Themig ..... | E21B 34/14<br>166/285 |

* cited by examiner

PRESSURE ACTIVATED PROPORTIONAL FLOW BYPASS TOOL ASSEMBLY

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a downhole tool for the oil and gas industry. Particularly, the present invention relates to a multiple use flow diverter tool assembly. Even more particularly, the present invention relates to a pressure activated proportional flow bypass.

2. Description of Related Art Including Information Disclosed Under 37 CFR 1.97 and 37 CFR 1.98

A bottom hole assembly (BHA) used in drilling and wellbore clean out or hole cleaning applications utilize a positive displacement motor (PDM) for well directional control and/or to rotate the drill bit of the BHA. These PDM motors are typically referred to as mud motors. Fluid pumped through the rotor/stator portion of the motor, generally called the PDM power section, results in bit rotation. Bit rotation, in revolutions per minute (rpm), is directly proportional to the flow rate pumped though the power section.

PDM power sections have a maximum flow rate specification due to their construction and selection of elastomer materials required to enable their functionality. The power section maximum flow rate value is the limiting factor in the BHA when higher flow rates are considered. It is important to avoid exceeding the power section maximum flow rate value, as stator failure will likely occur, resulting in non-productive time due to an unnecessary trip out of the hole to replace damaged equipment.

However, it is advantageous to increase the flow rate through the BHA above the power section maximum flow rate value for other activities, besides rotating the drill bit for drilling. For example, the increased flow rate can be used for hole cleaning purposes. Hole cleaning is a term used to describe removal of drill bit cuttings and other debris from the wellbore during drilling and/or clean out operations in cased wellbores. Hole cleaning results are improved, if the fluid in the annular space between the wellbore or casing inside diameter and the BHA and other tubulars outside diameters, is being pumped to surface in a turbulent flow regime. Turbulent flow better entrains solid particles in the flow stream allowing these solids to be pumped to surface, removing them from the wellbore. Fluid velocity (feet per minute) in the annular space, referred to as annular velocity, is the key independent variable in achieving turbulence as defined by the Reynold's number calculation.

$$R_e = \frac{928 * \rho * AV * (D_h - D_p)}{60 * \mu} \tag{1}$$

Where: $R_e$=Reynold's number, dimensionless
ρ=fluid density (ppg)
AV=annular velocity (ft/min.)
$D_h$=inside diameter of casing or hole size (in.)
$D_p$=outside diameter of pipe, BHA, tubing (in.)
μ=fluid viscosity (cp)

Annular velocity is related to flow rate (gallons per minute) by equation (2) below.

$$AV = \frac{24.5 * Q}{D_h^2 - D_p^2} \tag{2}$$

Where: AV=annular velocity (ft/min.)
Q=flow rate (gpm.)
$D_h$=inside diameter of casing or hole size (in.)
$D_p$=outside diameter of pipe, BHA, tubing (in.)

For a given set of tubulars, annular velocity is directly proportional to flow rate. One should be aware that the BHA outside diameter is greater than the pipe or coiled tubing outside diameter that conveyed the BHA to the bottom of the well. Annular velocity values are calculated around the BHA and around the pipe or tubing. The annular velocity value around the pipe or tubing is of greater interest since it is a lower value due to increased annular flow area. This results in a reduced Reynolds number and more difficulty in achieving turbulent flow.

The Reynold's number is directly proportional to annular velocity for given tubular and fluid conditions and annular velocity is directly proportional to flow rate under the same conditions. A greater flow rate is required to increase the Reynolds's number such that a turbulent flow regime is achieved.

Downhole tools, that allow for increased flow rates without damaging a PDM power section, currently exist. These tools can be operated one time, for instance when a pressure relief disc is used or a limited amount of times when using tools activated by dropping a ball or dart down the inside diameter of the pipe. These style tools are inefficient, bypass 100% of the flow to the annulus and provide limited capability to respond to unplanned events.

More recently tools have been developed that attempt to divide flow to the annulus and through the BHA. These tools have experienced erosion and failure to return to a fully closed position due to foreign matter becoming enmeshed in the internal mechanism of the tool. When a tool fails to close fully, the flow rate to the PDM may be insufficient for it to operate in its proper range. These operational shortcomings cause extra time to be expended to retrieve and replace a non-functioning tool and then return a new tool to the same measured depth as the failed tool. Daily operating costs can be $50,000.00 per day or greater. The cost of replacing a failed tool can be a significant and unnecessary additional cost in the operator's total well cost.

Various patents and patent applications have been published in the field of these prior art bypass and control valve systems. References include U.S. Pat. No. 9,260,938, issued to Holderman et al on 16 Feb. 2016, U.S. Pat. No. 6,675,897, issued to McGarian et al on 13 Jan. 2004, U.S. Pat. No. 9,903,180, issued to Boutin et al on 27 Feb. 2018, U.S. Pat. No. 8,534,369, issued to deBoer on 17 Sep. 2013, U.S. Pat. No. 6,293,342, issued to McGarian et al on 25 Sep. 2001, U.S. Pat. No. 7,334,597, issued to Hughes et al on 26 Feb. 2008, U.S. Pat. No. 7,299,880, issued to LoGuidice et al on 27 Nov. 2007, U.S. Pat. No. 9,708,872, issued to O'Neal et al on 18 Jul. 2017, U.S. patent Ser. No. 10/100,605, issued to Gay et al on 16 Oct. 2018, U.S. Pat. No. 9,890,601, issued to Baudoin on 13 Feb. 2018, U.S. Pat. No. 9,404,326, issued to Zhou on 2 Aug. 2016, U.S. patent Ser. No. 10/107,073, issued to Cramer et al on 23 Oct. 2018, U.S. Pat. No. 9,494,014, issued to Manke et al on 15 Nov. 2016, U.S. Pat. No. 8,393,403, issued to de Boer on 12 Mar. 2013, and U.S. Pat. No. 7,891,428, issued to Martin et al on 22 Feb. 2011.

It is an object of the present invention to provide a tool assembly for fluid bypass.

It is an object of the present invention to provide a tool assembly that allows increased flow rate without damaging or limiting the flow rate limited tools on the drill string.

It is another object of the present invention to position a flow bypass tool assembly above the flow rate limited tools.

It is an object of the present invention to provide a tool assembly that is pressure activated for multiple repeated fluid bypasses.

It is an object of the present invention to provide a tool assembly for proportional flow split through the tool assembly and through the bypass assembly to the annulus.

These and other objectives and advantages of the present invention will become apparent from a reading of the attached specifications and appended claims.

BRIEF SUMMARY OF THE INVENTION

Embodiments of the tool assembly of the present invention can be used in both the drilling and completion phases of a well. In coordination with other downhole tools, such as a bottom hole assembly (BHA), the tool assembly allows flow rates to increase, without exceeding surface pressure limits and without flow related damage to flow rate restricted tools, such as the BHA. The tool assembly includes a main body and a bypass assembly removably attached to the main body.

The main body includes an off-set through bore and a cavity with a cavity surface. The cavity surface includes components to engage the bypass assembly. There can be a cavity attachment means, a channel surface centered over the off-set through bore, a first fluid bypass port, a second fluid bypass port, and a pressure inlet port aligned with the fluid bypass ports and placed between the fluid bypass ports and the second cavity end.

Embodiments of the present invention also include a flow restrictor means in fluid connection with the pressure inlet port. The flow restrictor means is placed within the off-set through bore. The flow restrictor means can be a nozzle, venturi, bluff body or other known components to control fluid flow to build a pressure differential across the flow restrictor means. The present invention includes a bluff body port and bluff body and a pressure inlet insert as the flow restrictor means.

The bypass assembly fits within the cavity of the main body, and there are respective components to component on the cavity surface of the main body. The bypass assembly includes a bypass housing, a pressure chamber, a piston, and a spring assembly. The bypass housing has a first fluid bypass hole and a second fluid bypass hole, which both align with the first fluid bypass port and the second fluid bypass port on the main body. Similarly, there is a pressure inlet hole on the bypass housing to align with the pressure inlet port of the main body. In the present invention, the pressure inlet hole is in fluid connection with the pressure chamber. Thus, the pressure differential across the flow restrictor means increases pressure in the pressure chamber. The piston abuts the pressure chamber so that the piston and the spring assembly exert pressure against each other.

Embodiments of the present invention further include a method of using the tool assembly. The method for controlling flow includes deploying the tool assembly into a wellbore, with the piston starting in a first piston position. Fluid is pumped from a surface location through or by the flow restrictor means within the bypass housing so as to create a pressure differential across the flow restrictor means and in the pressure chamber. The piston actuates from the first piston position to the second piston position with the pressure differential. Now, a portion of the fluid from the surface location flows through the tool assembly and another portion of the fluid from the surface location flows through the first fluid bypass hole and the second fluid bypass hole to the wellbore.

The first fluid bypass hole and the second fluid bypass hole allow flow through the bypass assembly to the annulus concurrent with a flow through main body when a predetermined flow rate is achieved at the flow restrictor. There is now bypass flow through a sidewall of the tool assembly and through the tool assembly. The bypass flow can be set so that proportional flow is developed through the bypass assembly and through the main body to other downhole tools, such as a BHA, below the tool assembly.

DETAILED DESCRIPTION OF THE INVENTION

Referring to FIGS. 1-14, the tool assembly 10 of the present invention diverts flow to an annulus of a wellbore and maintains flow to the bottom hole assembly on a drill string within the wellbore. The flow rate to the bottom hole assembly can be safely maintained for work by the drill bit at the end of the drill string, while also preserving the ability to perform hole cleaning functions at a faster flow rate, which would not have been safe for the functionality of the drill bit. The tool assembly 10 is re-useable, unlike prior art diverters with single use ball drop activated tools. The tool assembly 10 provides a controlled system of proportional flow to both drilling and hole cleaning the wellbore without delays and resetting tools on the drill string.

Figure 1:
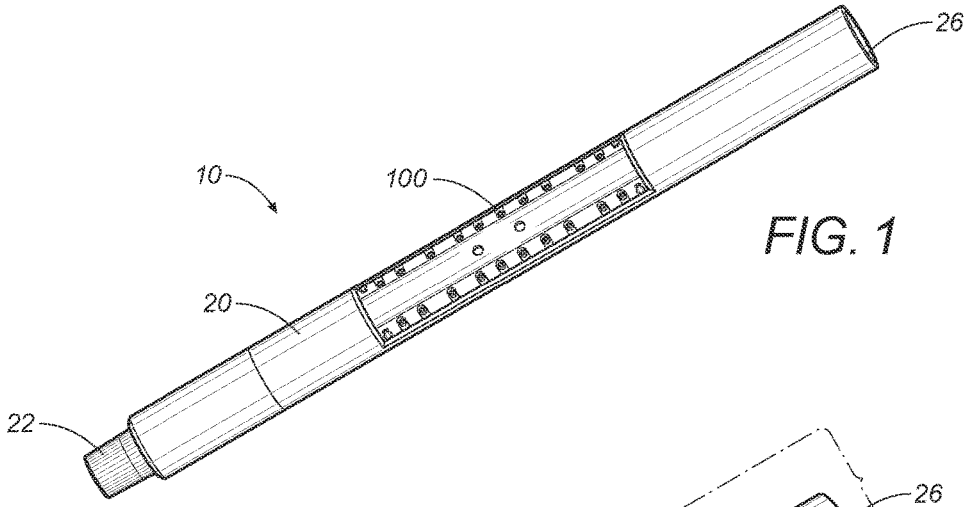
FIG. 1 is an upper perspective view of an embodiment of the tool assembly according to the present invention.
Figure 2:
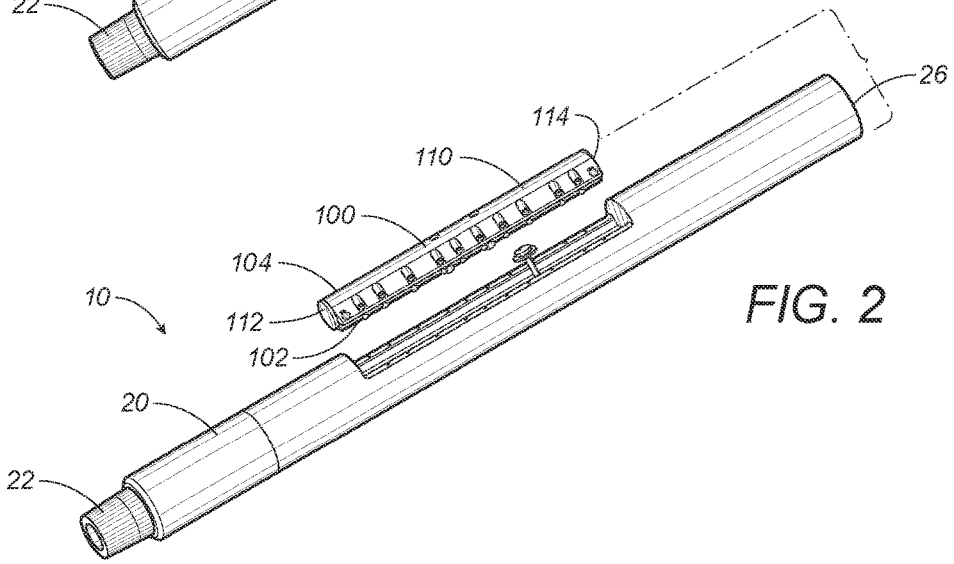
FIG. 2 is an exploded perspective view of an embodiment of the tool assembly according to the present invention.

Embodiments of the tool assembly 10 include a main body 20 having a proximal end 22 with a proximal opening 24 and a distal end 26 opposite the proximal end with a distal opening 28, and a bypass assembly 100 removably attached to the main body and having an inner side 102 and an outer side 104 opposite the inner side, as shown in FIGS. 1-2. As shown in FIGS. 3-6, the main body 20 can be comprised of an off-set through bore 30 in fluid connection with the proximal opening 24 and the distal opening 28, a mounting body portion 32 adjacent the off-set through bore 30, and a support portion 34 adjacent the off-set through bore 30 opposite the mounting body portion 32. The proximal opening 24 is wider than the off-set through bore 30, in terms of diameter, and the distal opening 28 is also wider than the off-set through bore 30 in terms of diameter. There can be gradual sloped transitions from the wider diameter to the smaller constant diameter.

Figure 3:
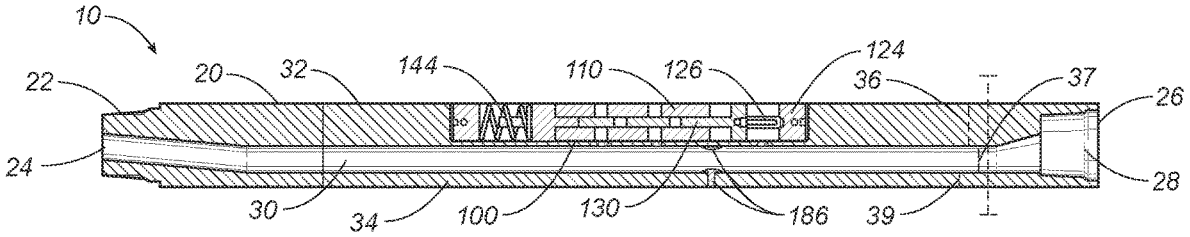
FIG. 3 is a cross-sectional view of an embodiment of the tool assembly according to the present invention with the piston in the first piston position.
Figure 4:
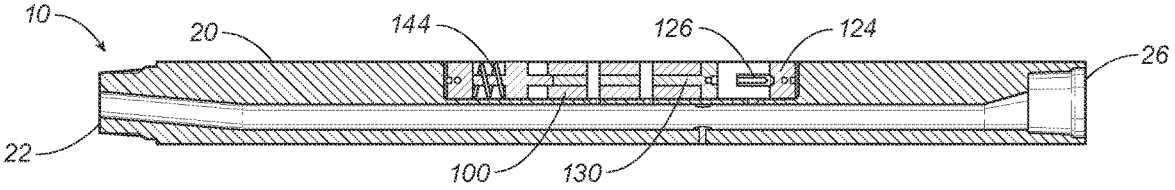
FIG. 4 is another cross-sectional view of an embodiment of the tool assembly according to the present invention with the piston in the second piston position.
Figure 5:
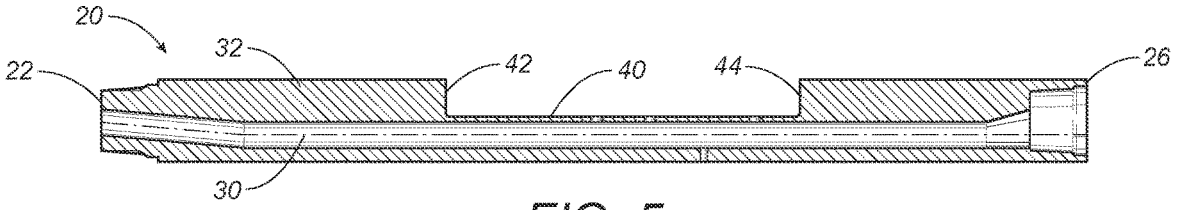
FIG. 5 is a cross-sectional view of an embodiment of the main body of the tool assembly according to the present invention.

FIGS. 3-5 show the mounting body portion 32 having a center portion 36 with a constant cross-section. Between the sloped transitions, the components of the main body 20 have set relationships to each other. The off-set through bore 30 requires these transitions from the drill string with a centered fluid passageway. In the main body 20, the centered fluid passageway transitions into the off-set through bore 30. The center portion 36 is aligned with a center section 37 of the off-set through bore 30 30, and this center section of the off-set through bore 30 also has a constant cross-section. The center portion 36 is also aligned with a center support section 39 of the support portion 34, and this center support section 39 also has its own constant cross-section. The alignment of the center portions 36, 37, and 39 allow the components of the main body 20 and the bypass assembly 100 to also be aligned under consistent conditions. Components of the main body 20 and the bypass assembly 100 are connected separate from the transitions from the centered fluid passageway to the off-set through bore 30.

Figure 6:
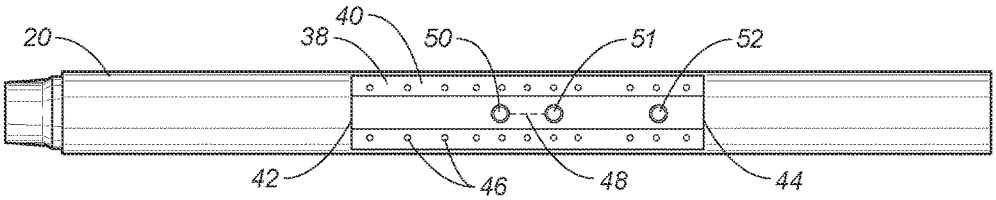
FIG. 6 is a top plan view of the main body in FIG. 4 and exploded view of an alternate embodiment of the bypass assembly and pressure inlet insert according to the present invention.
Figure 6:
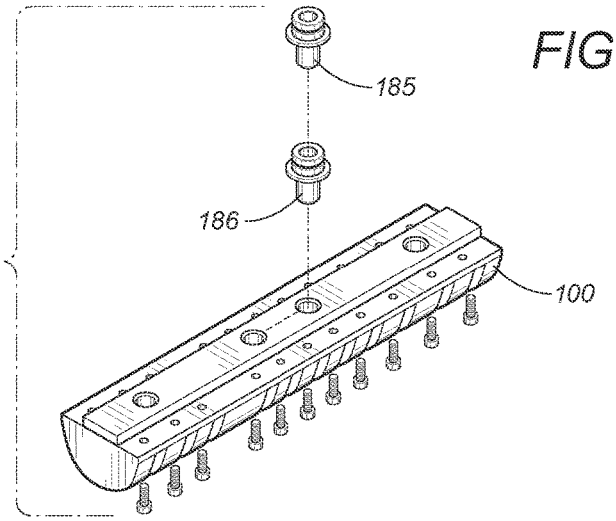

FIGS. 5-6 show a cavity 38 within the mounting body portion 32. The cavity 38 can be within the center portion 36 of the mounting body portion 32. The cavity 38 is comprised of cavity surface 40, a first cavity end 42 between the cavity surface 40 and the proximal end 22, and a second cavity end 44 between the cavity surface 40 and the distal end 26. The cavity surface 40 can include a cavity attachment means 46, a channel surface 48 centered over the off-set through bore 30, a first fluid bypass port 50 longitudinally aligned on a center axis of the channel surface 40, a second fluid bypass port 51 longitudinally aligned on the center axis of the channel surface, and a pressure inlet port 52 aligned with the fluid bypass ports 50, 51 and placed between the fluid bypass ports 50, 51 and the second cavity end 44.

The ports 50, 51, 52 are in fluid connection with the off-set through bore 30. The first fluid bypass port 50 is positioned a set distance 99 from the second fluid bypass port 51. The first fluid bypass port 50 is in fluid connection with the off-set through bore 30. The second fluid bypass port 51 is also in fluid connection with the off-set through bore 30, separate from the first fluid bypass port 50. The pressure inlet port 52 is also in fluid connection with the off-set through bore 30, separate from both the first fluid bypass port 50 and the second fluid bypass port 51.

Figure 7:
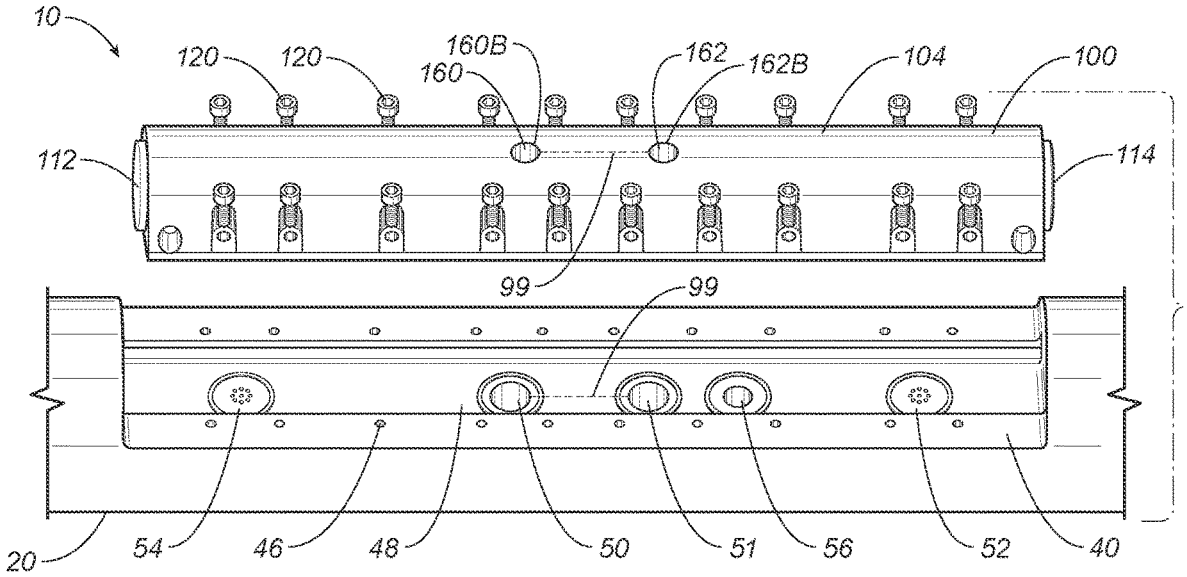
FIG. 7 is another exploded perspective view of an embodiment of the main body and bypass assembly according to the present invention.

The cavity attachment means 46 refers to structures, such as bolts, screws and threads. FIGS. 6-7 show the cavity attachment means 46 aligned in rows on sides of the cavity surface 40.

There is also a flow restrictor means 186 in fluid connection with the pressure inlet port 52, as shown in FIGS. 3-4, 6, 8-10, and 13-14. The flow restrictor means 186 is placed within the off-set through bore 30. The flow restrictor means 186 refers to structures, such as a nozzle, venturi, bluff body 180 or other known components to control fluid flow. In the embodiment of FIGS. 8-10 and 13-14, the flow restrictor means 186 is the bluff body 180. FIG. 7 shows the corresponding alternative embodiment of the main body 20 with a bluff body port 56 for the embodiment of the flow restrictor means 186 as the bluff body 180. The bluff body port 56 is aligned with the fluid bypass ports 50, 51 on the channel surface 40 and placed between the fluid bypass ports 50, 51 and the first cavity end 44. The bluff body port 56 is between the fluid bypass ports 50, 51 and the pressure inlet port 52. FIG. 6 shows still another alternative embodiment of the flow restrictor 186. There can be a pressure inlet insert 185 connected to the bypass assembly 100, in particular, inserted into the first fluid bypass hole 160 or the second fluid bypass hole 162. This pressure inlet insert 185 can have a bluff body type extension that can restrict flow. Thus, the pressure inlet insert 185 can be the flow restrictor means 186. A separate bluff body is not required in this embodiment.

Embodiments of the tool assembly 10 include the bypass assembly 100 removably attached to the main body 20 within the cavity 48 and having an inner side 102 and an outer side 104 opposite the inner side 102.

FIGS. 6-14 show the bypass assembly 100 comprising a bypass housing 110 having a proximal bypass end 112 and a distal bypass end 114 opposite the proximal bypass end 112, a bypass attachment means 120 made integral with the bypass housing 110, a pressure chamber 122 at the distal bypass end 114, a piston 130 having a first piston end 132 and a second piston end 134 opposite the first piston end 132, and a spring assembly 140 having a proximal end cap 142 at the proximal bypass end 112 and a spring member 144 engaged with the first piston end 132.

Figure 8:
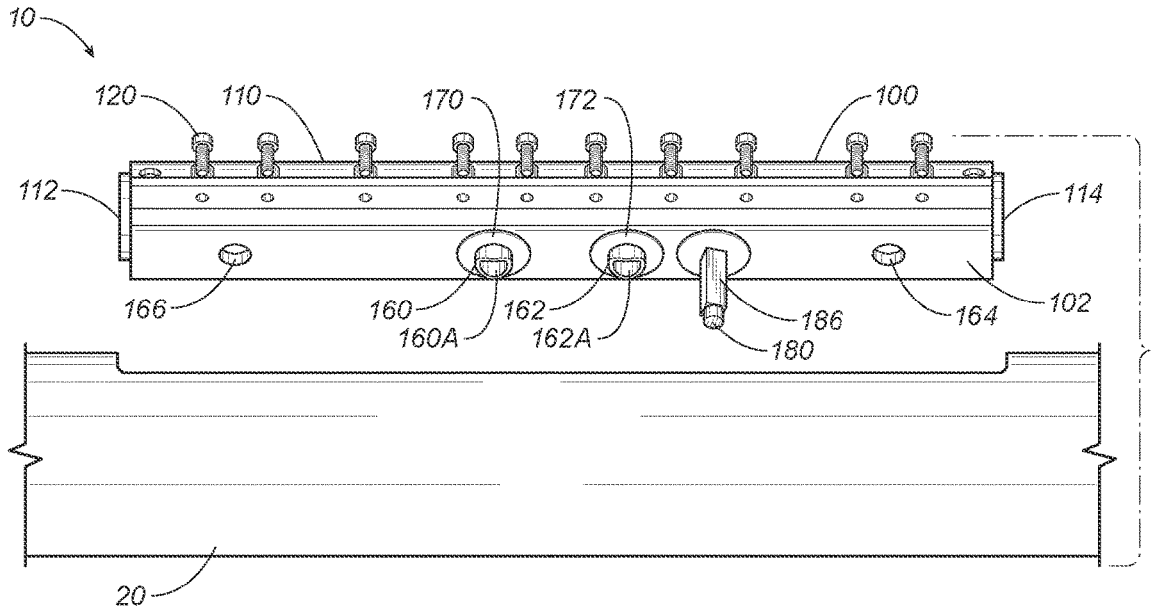
FIG. 8 is an exploded lower perspective view of an embodiment of the main body and bypass assembly according to the present invention.

The bypass attachment means 120 also refers to structures, such as bolts, screws and threads. FIGS. 7-8 show the bypass attachment means 120 aligned in rows on sides of the bypass housing 110. FIG. 7 further shows that the bypass attachment means 120 is complementary to the cavity attachment means 46 on the main body 20. These components cooperatively connect the bypass assembly 100 to the main body 20.

The pressure chamber 122 has a distal end cap 124 and a pressure stop 126. The distal end cap 124 is set against the distal bypass end 114, and the pressure stop 126 extends from the distal end cap 124 toward the proximal bypass end 112. The second piston end 134 faces the pressure chamber 122 at the pressure stop 126.

Figure 13:
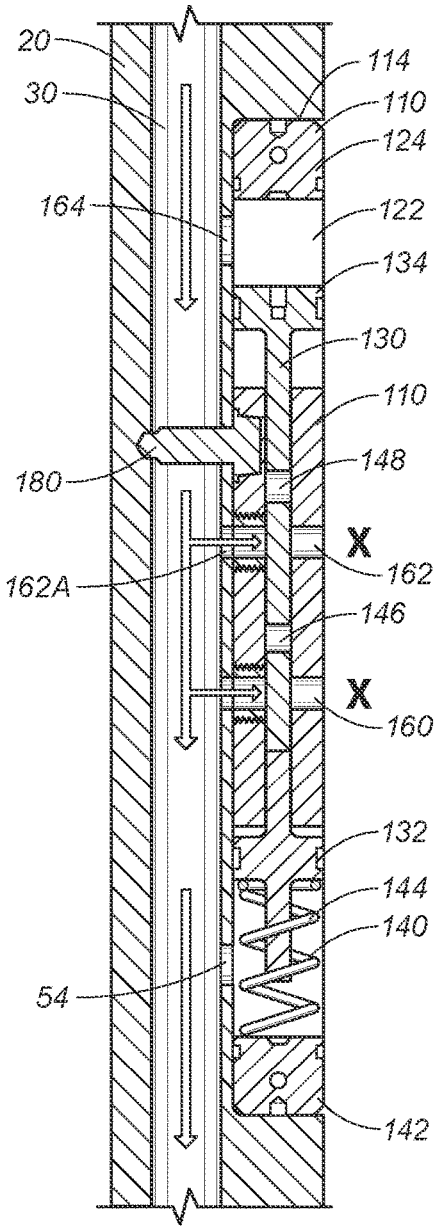
FIG. 13 is a cross-sectional view of an embodiment of the tool assembly according to the present invention with the piston in the first piston position.
Figure 14:
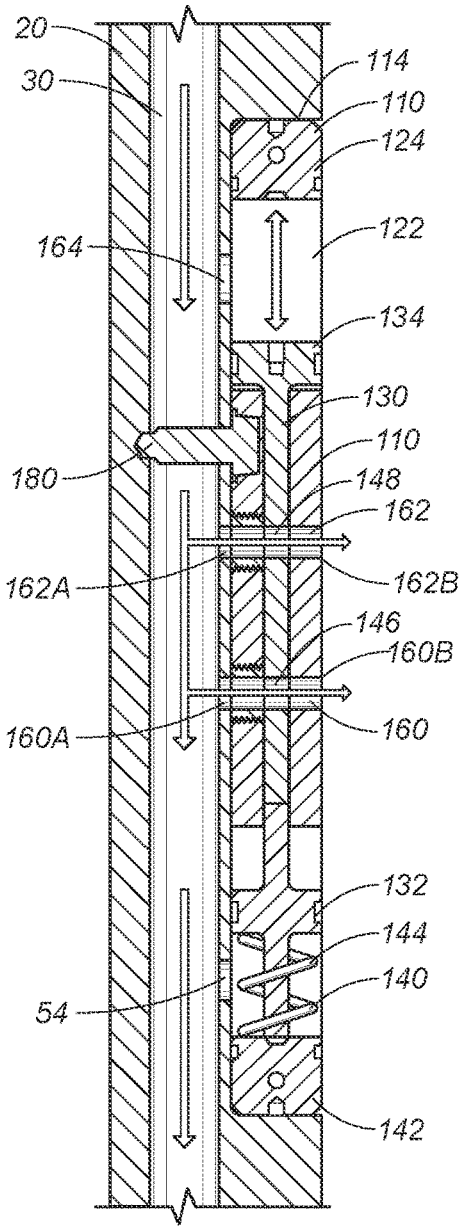
FIG. 14 is another cross-sectional view of an embodiment of the tool assembly according to the present invention with the piston in the second piston position.

The piston 130 has a first piston position and a second piston position. In FIG. 13, the first piston position corresponds to the spring member 144 in an extended configuration and the pressure stop 126 abutting the second piston end 134. In FIG. 14, the second piston position corresponds to the spring member 144 in a compressed configuration and the pressure stop 126 being separated from the second piston end 134. The first piston position is the closed configuration without any fluid flow through the bypass assembly 100 to the annulus of the wellbore. The piston 130 blocks flow, and the outer side 104 of the bypass assembly 100 is sealed to the off-set through bore 30. The second piston end 134 abuts the pressure stop 126 in the first piston position. The second piston position is the opened configuration with fluid flow through the bypass assembly 100 to the annulus of the wellbore. The piston 130 allows flow and the fluid connection between the off-set through bore 30 to the annulus through the bypass assembly 100.

Embodiments of the piston 130 are shown in FIGS. 9-14. The piston 130 has a first piston flow hole 146 and a second piston flow hole 148. The first piston flow hole 146 and the second piston flow hole 148 are between the first piston end 132 and the second piston end 134. FIGS. 9-14 show the first piston flow hole 146 positioned at the set distance 99 from the second piston flow hole 148. It is the same set distance 99 between the first fluid bypass port 50 and the second fluid bypass port 51. The first piston flow hole 146 and the second piston flow hole 148 can be aligned with the first fluid bypass port 50 and the second fluid bypass port 51, respectively, as shown in FIGS. 13-14.

One embodiment of the first piston end 132 is shown in FIGS. 13-14. The first piston end 132 is comprised of a piston plate 150 and a piston stem 152 protruding from the piston plate 150 toward the proximal bypass end 112. The piston plate 150 can be a spring stop so that the spring member 144 is always abutting the piston plate 150. The piston plate 150 moves as the spring member 144 is expanded or compressed. In this embodiment, the piston stem 152 is separated from the proximal end cap 142, and the piston plate 150 as the pressure stop abuts the spring member 144, in the first piston position of FIG. 13. The piston stem 152 abuts the proximal end cap 142, and the piston plate 150 as the pressure stop still abuts the spring member 144 in the second piston position of FIG. 14.

FIGS. 7-8 and 13-14 show additional features of the bypass housing 110, including a first fluid bypass hole 160, a second fluid bypass hole 162, and a pressure inlet hole 164. The first fluid bypass hole 160 extends through the bypass housing 110 and has a first fluid bypass inner opening 160A and a first fluid bypass outer opening 160B opposite the first fluid bypass inner opening. The second fluid bypass hole 162 extends through the bypass housing 110 and has a second fluid bypass inner opening 162A and a second fluid bypass outer opening 162B opposite the second fluid bypass inner opening. The pressure inlet hole 164 extends through the inner side 102 of the bypass housing 110 to the pressure chamber 122. The pressure chamber 122 is aligned with the pressure inlet port 52, and the pressure chamber 122 is in fluid connection with the pressure inlet port 52 and the off-set through bore 30 through the pressure inlet hole 164.

The first fluid bypass hole 160 and the second fluid bypass hole 162 are between the proximal bypass end 112 and the distal bypass end 114. The first fluid bypass hole 160 is also positioned the set distance 99 from the second fluid bypass hole 162. Again, it is the same set distance 99 between the first fluid bypass port 50 and the second fluid bypass port 51 and between the first piston flow hole 146 and the second piston flow hole 148. As shown in FIGS. 13-14, the first fluid bypass port 50 and the second fluid bypass port 51, the first piston flow hole 146 and the second piston flow hole 148, and the first fluid bypass hole 160 and the second fluid bypass hole 162, can all be aligned respectively, as shown in FIG. 14.

Figure 9:
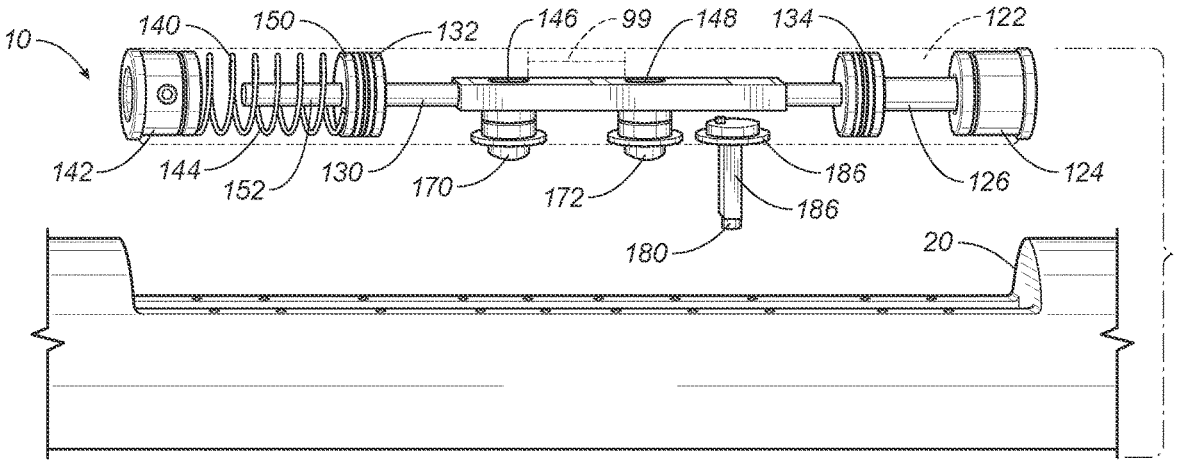
FIG. 9 is a side elevation and interior view of an embodiment of the bypass assembly and main body according to the present invention.
Figure 10:
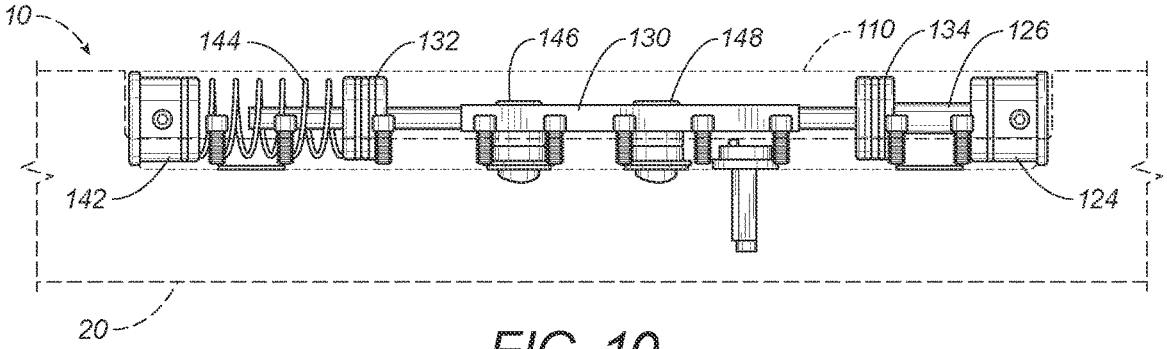
FIG. 10 is a side elevation and interior view of an embodiment of the bypass assembly according to the present invention.

Still another embodiment of the bypass assembly 100 is shown in FIGS. 8-10. There can be a first extended insert 170 connected to the first fluid bypass hole 160. The first extended insert 170 is set between the first fluid bypass inner opening 160A and the first fluid bypass port 50. The first fluid bypass hole 160 is in fluid connection with the first fluid bypass port 50 through the first extended insert 170. There can also be a second extended insert 172 connected to the second fluid bypass hole 162. The second extended insert 172 is set between the second fluid bypass inner opening 162A and the second fluid bypass port 51. The second fluid bypass hole 162 is in fluid connection with the second fluid bypass port 51 through the second extended insert 172.

There are also alternative embodiments with variations in both the main body 20 and the bypass assembly 100. These alternative embodiments have analogous structures between the main body 20 and the bypass assembly 100. FIGS. 7-8 and 13-14 show these alternative embodiments. The main body 20 can further include a pressure equalization port 54 aligned with the first fluid bypass port 50 and the second fluid bypass 51 on the channel surface 40 and placed between the first fluid bypass port 50 and the second fluid bypass 51 and the first cavity end 42. There is the corresponding structure on the bypass assembly 100 as a pressure equalization hole 166 extending through the inner side 102 of the bypass housing 110 to the spring assembly 144. The spring assembly 144 is aligned with the pressure equalization port 54.

For the different flow restrictor means 186, FIGS. 7-8 and 13-14 show that embodiment with the bluff body port 56 as part of the flow restrictor means 186. There is already the bluff body port 56 aligned with the first fluid bypass port 50 and the second fluid bypass 51 on the channel surface 40 and placed between the first fluid bypass port 50 and the second fluid bypass 51 and the second cavity end 44. This alternative in FIGS. 7-8 and 13-14 show a bluff body 180. The bluff body 180 is mounted on the bypass housing 110 and extends through the bluff body port 56. The bluff body 180 is in fluid connection with the off-set through bore 30. The flow restrictor means 186 of this embodiment is further comprised of the bluff body 180, in addition to the bluff body port 56.

Figure 11:
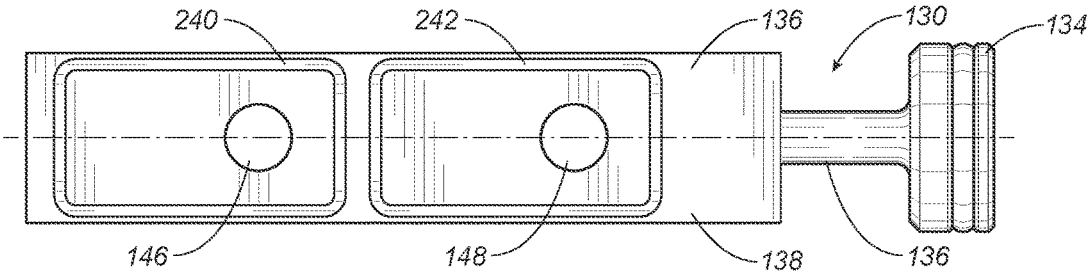
FIG. 11 is a schematic view of an embodiment of the piston according to the present invention.
Figure 12:
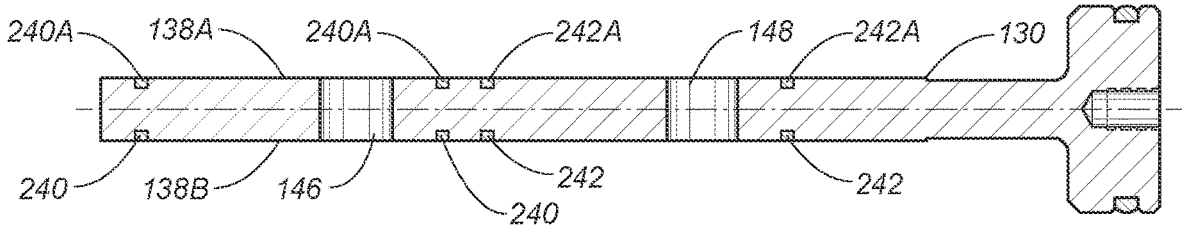
FIG. 12 is a cross-sectional view of an embodiment of the piston of FIG. 11.

The present invention further includes some alternate embodiments of the piston 130 as shown in FIGS. 11-12. In addition to the first piston position and the second piston position being related to the spring member 144 and the second piston end 134, the first piston position also corresponds to the first fluid bypass outer opening 1606 in sealed connection to the off-set through bore 30 by the piston 130 and the second fluid bypass outer opening 162B in sealed connection to the off-set through bore 30 by the piston 130. The spring assembly 144 is in a positive pressure relationship with the pressure chamber 122, which means that the spring assembly 144 exerts more force against the pressure chamber 122 than the pressure chamber 122 exerts on the spring assembly 144. The pressure in the pressure chamber 122 has not increased enough to open the flow through the bypass assembly 100, as in FIG. 13. Similarly, the second piston position corresponds to the first fluid bypass outer opening 1606 in fluid connection with the off-set through bore 30 through the first piston flow hole 146 and the second fluid bypass outer opening 162B in fluid connection with the off-set through bore 30 through the second piston flow hole 148. The pressure chamber 122 is now in a positive pressure relationship with the spring assembly 144. The pressure chamber 122 now exerts more force against the spring member 144 than the spring member 144 exerts against the pressure chamber 122. The pressure in the pressure chamber 122 has increase enough to open the flow through the bypass assembly 100. The movement between the first piston position and the second piston position can be alternated back and forth and repeated. The release of flow to the annulus through the bypass assembly 100 is no longer a one-time ball drop or dart trigger.

FIGS. 11-12 further show the piston being comprised of a piston body 136. The piston body 136 can be comprised of a plate member 138 having an upper plate member side 138A and a lower plate member side 138B. The first piston flow hole 146 and the second piston flow hole 148 are positioned on the plate member 138. Additionally, the piston body 136 can be further comprised of a first face seal 240 on the lower plate member side 138B and a second face seal 242 on the lower plate member side plate member 1386. These seals create the sealed connection or fluid connection through the first fluid bypass hole 160 and the second fluid bypass hole 162 as blocked by the plate member 138 or connected through the first piston flow hole 146 and the second piston flow hole 148. FIG. 12 further shows another first face seal 240A on the upper plate member side 138A and another second face seal 242A on the upper plate member side plate member 138A. The face seals 240, 240A, 242, 242A are able to slide on the plate member 138. The first face seal 240 is placed around the first piston flow hole 146, and the second face seal 242 is placed around the second piston flow hole 148.

Embodiments of the present invention further include a method of using the tool assembly 10. The method for controlling flow includes deploying the tool assembly 10 into a wellbore, with the piston 130 starting in the first piston position. Then, fluid is pumped from a surface location through the flow restrictor means 186 within the bypass housing 110 so as to create a pressure differential across the flow restrictor means 186 with the off-set through bore 30. The pressure chamber 122 and a portion the off-set through bore 30 between the surface location and the flow restrictor means 186 are one side of the flow restrictor means 186. Another portion of the off-set through bore 30 between the flow restrictor means 186 and the proximal bypass end 112 are on another side of the flow restrictor means 186. The pressure differential increases as the pressure on the one side with the pressure chamber 122 can be increased with increased flow rate from the surface. The piston 130 actuates from the first piston position to the second piston position with the pressure differential. Now, a portion of the fluid from the surface location flows through the tool assembly 10 and another portion of the fluid from the surface location flows through the first fluid bypass hole 160 and the second fluid bypass hole 162 to the wellbore.

In the embodiments of the method, the portion of the fluid through the tool assembly 10 and the another portion of the fluid through the first fluid bypass hole 160 and the second fluid bypass hole 162 are proportional according to a hole diameter of the off set through bore 30, a first bypass hole diameter of the first fluid bypass hole 160, and a second bypass hole diameter of the second fluid bypass hole 162. Furthermore, the portion of the fluid through the tool assembly 10 and the another portion of the fluid through the first fluid bypass hole 160 and the second fluid bypass hole 162 are proportional according to a hole area of the off set through bore 30, a first bypass hole area of the first fluid bypass hole 160, and a second bypass hole area of the second fluid bypass hole 162. The selection of physical dimensions can determine the range of flow rates and proportional flow that can be achieved with the tool assembly 10.

Additionally, the flow restrictor means 186 can still be a bluff body 180 or even a nozzle or venturi, in the method of the using the invention. The flow restrictor means 186 is the boundary between the pressure differential. The fluid can flow through or by the flow restrictor means. In some embodiments, the spring member 144 has a spring rate corresponding to a predetermined flow rate of the fluid from the surface location and the pressure differential. Selecting the spring member 144 can also determine the range of flow rates and proportional flow that can be achieved with the tool assembly 10.

The method of using the present invention is not a single use flow diverter. The method can include reducing pumping the fluid from the surface location and actuating the piston 130 from the second piston position to the first piston position. In that first piston position, fluid flows from the surface location through the tool assembly 10. The first piston position closes the first fluid bypass hole 160 and the second fluid bypass hole 162. However, the first fluid bypass hole 160 and the second fluid bypass hole 162 can be re-opened by changing flow rates again. There is no shut down or complicated removal of a ball that triggered a pressure seat valve.

In the present invention, a pressure differential is created by passing the fluid pumped from surface through a flow restrictor in the inside diameter of the tool, in particular, in the off-set through bore. This invention can use a nozzle or venturi or bluff body or pressure inlet insert to develop the pressure differential.

For a nozzle the pressure drop can be calculated from the following equation (3).

$$P = \frac{MW * Q^2}{(12032) * C_d^2 * A^2} \tag{3}$$

Where: P is nozzle prressure loss (psi)

MW is mud weight (ppg)

Q is flow rate (gpm)

A is area of the nozzle ($in^2$)

$C_d$ is discharge coefficient (dimensionless)

Using values of interest and assumming $C_d$=1 and MW=8.2 ppg, pressure loss can be calculated at certain flow rates. The top end of the open/close slide piston in the flow self-contained bypass assembly experiences these pressure values.

| Nozzle Pressure Drop with $C_d$ = 1 & Mud Weight = 8.2 ppg | | | |
|---|---|---|---|
| Nozzle ID (in) | .875 | .81 | .75 |
| Nozzle ID Area ($in^2$) | .601 | .515 | .442 |
| Press. drop (psi)@ 110 gpm | 23 | 31 | 42 |
| Press. drop (psi)@ 190 gpm | 68 | 93 | 126 |

For a venturi the pressure loss can be calculated from the following equation (4)

$$\Delta P = \frac{MW}{2} * \left\{1 - \left(\frac{A_2}{A_1}\right)^2\right\} * \left(\frac{Q}{A_2}\right)^2 \quad (4)$$

Where: ΔP is pressure loss (psi)

MW is mud weight (ppg)

$A_1$ is flow area through tool ID ($in^2$)

$A_2$ is flow area through venturi throat ($in^2$)

Q is flow rate (gpm)

Using values of interest and assuming tool inner diameter (ID)=1" and MW=8.2 ppg, pressure loss can be calculated at certain flow rates Pressure values developed with a nozzle or venturi flow restriction implementation are experienced at the top end of the open/close slide piston in the self-contained bypass assembly. The cross-sectional area (int) of the open/close slide piston top times the pressure value (psi) developed by the nozzle or venturi creates a force that can overcome the spring rate and friction that keeps the open/close slide in the closed position.

The spring member can have a spring rate that keeps the open/close slide in the closed position blocking flow from the inner diameter (ID) of the tool to the annulus until a predetermined flow rate and pressure drop (as described above) creates an opposing force that overcomes the spring rate and any friction. When this occurs the open/close slide moves approximately 0.75", aligning flow holes in the self-contained bypass assembly with the lower two ports in the main body. Flow is then established from the ID of the tool to the annulus The tool assembly achieves a proportional flow through the bottom of the tool and through the self-contained bypass assembly. The sizing of the relative flow areas (holes and ports) appropriately can determine the proportional flow. Using the example of a 1" internal diameter tool and two exit ports with a diameter of 0.438" each, the following data can be generated.

| | Main sub | Port 1 | Port 2 | Total | Main sub % | Port 1&2% | |
|---|---|---|---|---|---|---|---|
| Relative Flow Areas | | | | | | | |
| Hole Diameter (in) | 1 | 0.438 | 0.438 | 1.876 | | | |
| Hole Area ($in^2$) | 0.785 | 0.151 | 0.151 | 1.087 | 72.2% | 27.8% | |
| Proportional Flow | | | | | | | |
| GPM | | 190 | 210 | 230 | 250 | 270 | 290 |
| 1" hole - Main sub | 0.722 | 190 | 152 | 166 | 181 | 195 | 210 |
| 2 × .438" holes - Bypass | 0.278 | 0 | 58 | 64 | 69 | 75 | 80 |

In this example we keep the flow self-contained bypass assembly in the closed position until a flow rate of 190 gpm is established. At flow rates above 190 gpm, the pressure drop through the internal flow restriction is sufficient to move the open/close slide to the open position. Flow is then divided proportionally through the tool and through the self-contained bypass assembly based on the ratio of their flow areas to the total flow area. Approximately 28% of the flow will exit through the self-contained bypass assembly and 72% of the flow will exit through the bottom end of the tool.

The internal diameter of the lower port insert can be a greater or smaller dimension than 0.438" used in this example in order to adjust the percent of flow that passes through the tool and through the self-contained bypass assembly.

The embodiments of the present invention further provide a linear dynamic seal on the open/close slide piston rectangular section or plate member to control fluid flow through the bypass housing the fluid bypass holes transitions from closed to open and back to closed. The sealing system consists of elastomer seals. Four seals can be rectangular seals on the sliding plate member of the piston. These seals are present on both sides of the slide piston.

The lower port face seal prohibits bypass flow from the off set through bore to the annulus, when the piston is in the closed position by sealing against the solid portion of the plate member. In the opened position of the piston, the open area or bypass fluid holes of the bypass housing align with the open area or piston flow holes of the slide. The seal is positioned in a concentric fashion around these open areas allowing flow to pass through the plate member to the annulus. The embodiments as rectangular seals on both sides of the plate member or slide prevent fluid leakage as the plate member or slide transitions between the first and second piston positions.

The present invention provides a tool assembly for fluid bypass. The tool assembly enables increased flow rates above the conventional flow rates limited by certain downhole tools. Flow rate limited tools, such as the bottom hole assembly (BHA) previously limited flow rates. These flow rate limited tools have high risk of damage at the higher flow rates. Those prior art systems required drilling with the BHA to stop in order to remove debris, like cuttings. Performing the hole cleaning at the higher flow rates was not possible concurrent with drilling. These stoppages were usually achieved with single use bypass and control valves, triggered by balls or darts dropped into the wellbore. These balls and darts had to be removed in order to restart the drilling after the hole cleaning. These delays cost significant money. The present invention eliminates these stoppages.

The tool assembly of the present invention is positioned above the flow rate limited tools. The turbulent flow regime can be achieved with the bypass flow through the bypass assembly of the present invention. The flow at the safe flow rates for the flow rate limited tools can still be passed through the tool assembly of the present invention.

The tool assembly of the present invention has the pressure chamber and the spring member to control the proportional split of the flow. The flow restrictor means controls the pressure in the pressure chamber, which can act against the spring member. The desired proportional flow through the tool assembly to the other downhole tools and through the bypass assembly of the tool assembly for the turbulent flow in the annulus can be set by choosing the strength and other characteristics of the spring member and selecting the dimensions of the holes and ports in the tool assembly. The spring member and the pressure chamber can push back and forth, so the tool assembly is not a single use system. Fluid bypass holes can be opened and closed and opened and closed repeatedly without stopping the tool assembly. There are fewer delays and more efficient operations in the wellbore.

The foregoing disclosure and description of the invention is illustrative and explanatory thereof. Various changes in the details of the illustrated structures, construction and method can be made without departing from the true spirit of the invention.

We claim:

1. A tool assembly, comprising:

a main body having a proximal end with a proximal opening and a distal end opposite said proximal end with a distal opening, wherein said main body being comprised of an off-set through bore in fluid connection with said proximal opening and said distal opening, a mounting body portion adjacent said off-set through bore, and a support portion adjacent said off-set through bore opposite said mounting body portion;

a cavity within said mounting body portion, said cavity being comprised of cavity surface, a first cavity end between said cavity surface and said proximal end, and a second cavity end between said cavity surface and said distal end;

a flow restrictor means in fluid connection with a pressure inlet port; and a bypass assembly removably attached to said main body within said cavity and having an inner side and an outer side opposite said inner side, wherein said cavity surface is comprised of:

a cavity attachment means;

a channel surface centered over said off-set through bore;

a first fluid bypass port longitudinally aligned on a center axis of said channel surface, said first fluid bypass port being in fluid connection with said off-set through bore;

a second fluid bypass port longitudinally aligned on said center axis of said channel surface, said second fluid bypass port being in fluid connection with said off-set through bore, said first fluid bypass port being positioned a set distance from said second fluid bypass port; and said pressure inlet port aligned with said fluid bypass ports and placed either between said first fluid bypass port and said second cavity end or between said second fluid bypass port and said second cavity end, said pressure inlet port being in fluid connection with said off-set through bore, wherein said bypass assembly comprises:

a bypass housing having a proximal bypass end and a distal bypass end opposite said proximal bypass end;

a bypass attachment means made integral with said bypass housing;

a pressure chamber at said distal bypass end and having a distal end cap and a pressure stop, said distal end cap being set against said distal bypass end, said pressure stop extending from said distal end cap toward said proximal bypass end;

a piston having a first piston end and a second piston end opposite said first piston end, said second piston end facing said pressure chamber;

a spring assembly having a proximal end cap at said proximal bypass end and a spring member engaged with said first piston end;

a first fluid bypass hole extending through said bypass housing and having a first fluid bypass inner opening and a first fluid bypass outer opening opposite said first fluid bypass inner opening;

a second fluid bypass hole extending through said bypass housing and having a second fluid bypass inner opening and a second fluid bypass outer opening opposite said second fluid bypass inner opening; and a pressure inlet hole extending through said inner side of said bypass assembly to said pressure chamber, wherein said piston has a first piston flow hole and a second piston flow hole, said first piston flow hole and said second piston flow hole being between said first piston end and said second piston end, wherein said first piston flow hole is positioned at said set distance from said second piston flow hole, wherein said piston has a first piston position corresponding to said first fluid bypass outer opening in sealed connection to said off-set through bore by said piston and said second fluid bypass outer opening in sealed connection to said off-set through bore by said piston, wherein said piston has a second piston position corresponding to said first fluid bypass outer opening in fluid connection with said off-set through bore through said first piston flow hole and said second fluid bypass outer opening in fluid connection with said off-set through bore through said second piston flow hole, wherein said first fluid bypass hole is aligned with said first fluid bypass port, said second fluid bypass hole being aligned with said second fluid bypass port, wherein said first fluid bypass hole is positioned said set distance from said second fluid bypass hole, and wherein said pressure chamber is aligned with said pressure inlet port, said pressure chamber being in fluid connection with said pressure inlet port and said off-set through bore through said pressure inlet hole.

2. The tool assembly, according to claim 1, said mounting body portion having a center portion with a constant cross-section, wherein said center portion is aligned with a center section of said off-set through bore, said center section having a constant cross-section, and wherein said center portion is aligned with a center support section of said support portion, said center support section having a constant cross-section.

3. The tool assembly, according to claim 1, further comprising:

a pressure equalization port aligned with said first fluid bypass port and said second fluid bypass port on said channel surface and placed either between said first fluid bypass port and said first cavity end or between said second fluid bypass port and said first cavity end.

4. The tool assembly, according to claim 3, further comprising:

a pressure equalization hole extending through said inner side of said bypass assembly to said spring assembly, wherein said spring assembly is aligned with said pressure equalization port.

5. The tool assembly, according to claim 1, further comprising:

a bluff body port aligned with said first fluid bypass port and said second fluid bypass port on said channel surface and placed either between said first fluid bypass port and said second cavity end or between said second fluid bypass port and said second cavity end, wherein said flow restrictor means is comprised of said bluff body port.

6. The tool assembly, according to claim 5, further comprising:

a bluff body being mounted on said bypass housing and extending through said bluff body port, said bluff body being in fluid connection with said off-set through bore, wherein said flow restrictor means is further comprised of said bluff body.

7. The tool assembly, according to claim 1, wherein said first piston end is comprised of a piston plate and a piston stem protruding from said piston plate toward said proximal bypass end.

8. The tool assembly, according to claim 1, further comprising:

a first extended insert connected to said first fluid bypass hole.

9. The tool assembly, according to claim 8, further comprising:

a second extended insert connected to said second fluid bypass hole.

10. The tool assembly, according to claim 1, further comprising:

a pressure inlet insert connected to said first fluid bypass hole, wherein said flow restrictor means is comprised of said pressure inlet insert.

11. The tool assembly, according to claim 1, wherein said first piston position corresponds to said spring member in an extended configuration and said pressure stop abutting said second piston end.

12. The tool assembly, according to claim 1, wherein said second piston position corresponds to said spring member in a compressed configuration and said pressure stop being separated from said second piston end.

13. The tool assembly, according to claim 1, said piston being comprised of a piston body, wherein said piston body is comprised of a plate member having an upper plate member side and a lower plate member side, said first piston flow hole and said second piston flow hole being positioned on said plate member.

14. The tool assembly, according to claim 13, said piston body being further comprised of a first face seal on said lower plate member side and a second face seal on said lower plate member side.

15. The tool assembly, according to claim 14, said piston body being further comprised of another first face seal on said upper plate member side and another second face seal on said upper plate member side.

16. A method for flow in a wellbore, the method comprising the steps of:

deploying a tool assembly, according to claim 1, into the wellbore, with said piston in said first piston position;

pumping fluid from a surface location to the flow restrictor means within said bypass housing so as to create a pressure differential across the flow restrictor means in said off-set through bore, said pressure chamber and a portion of said off-set through bore between said surface location being on one side of the flow restrictor means and another portion of said off-set through bore between said flow restrictor and said proximal bypass end being on another side of the flow restrictor means;

actuating said piston from said first piston position to said second piston position with said pressure differential;

flowing a portion of said fluid from said surface location through said bypass assembly; and flowing another portion of said fluid from said surface location through said first fluid bypass hole and said second fluid bypass hole to the wellbore.

17. The method, according to claim 16, wherein said portion of said fluid through said tool assembly and said another portion of said fluid through said first fluid bypass hole and said second fluid bypass hole are proportional according to a hole diameter of said off set through bore, a first bypass hole diameter, and a second bypass hole diameter, and wherein said portion of said fluid through said tool assembly and said another portion of said fluid through said first fluid bypass hole and said second fluid bypass hole are proportional according to a hole area of said off set through bore, a first bypass hole area, and a second bypass hole area.

18. The method, according to claim 16, wherein said flow restrictor is a bluff body.

19. The method, according to claim 16, wherein said spring member has a spring rate corresponding to a predetermined flow rate of said fluid from said surface location to the flow restrictor means and said pressure differential across the flow restrictor means.

20. The method, according to claim 16, further comprising the steps of:

reducing pumping said fluid from said surface location; and actuating said piston from said second piston position to said first piston position.

* * * * *